US005866983A

United States Patent [19]

Prochazka et al.

[11] Patent Number: 5,866,983

[45] Date of Patent: Feb. 2, 1999

[54] PROTECTIVE METAL SILICATE COATING FOR ELECTRODELESS HID LAMPS

[75] Inventors: Svante Prochazka, Ballston Lake; Hsueh-Rong Chang, Schenectady, both of N.Y.

[73] Assignee: General Electric Company, Schenectady, N.Y.

[21] Appl. No.: 756,312

[22] Filed: Nov. 25, 1996

[51] Int. Cl.[6] ..... H01J 17/16

[52] U.S. Cl. ..... 313/635; 313/489; 313/637; 313/640

[58] Field of Search ..... 313/636, 489, 313/637, 640

[56] References Cited

U.S. PATENT DOCUMENTS

| | | | |
|---|---|---|---|
| Re. 30,165 | 12/1979 | Mason et al. | 313/221 |
| 2,030,397 | 2/1936 | Reynolds | 176/122 |
| 2,568,459 | 9/1951 | Noel | 313/221 |
| 3,984,590 | 10/1976 | Mason et al. | 427/106 |
| 4,047,067 | 9/1977 | Clausen | 313/221 |
| 4,256,988 | 3/1981 | Coaton et al. | 313/221 |
| 4,918,352 | 4/1990 | Hess et al. | 313/25 |
| 5,032,762 | 7/1991 | Spacil et al. | 313/635 |
| 5,270,615 | 12/1993 | Chang | 313/489 |

FOREIGN PATENT DOCUMENTS 58-110956 6/1983 Japan .

*Primary Examiner*—Vip Patel
*Attorney, Agent, or Firm*—Fay, Sharpe, Beall, Fagan, Minnich & McKee

[57] ABSTRACT

Sodium loss, free halide build-up, devitrification and wall etching of the arc chamber are substantially reduced in an electrodeless HID metal halide arc discharge lamp by a protective metal silicate coating present only on the interior, equatorial portion of the arc chamber wall which is closest to the arc plasma. Suitable coatings include a metal silicate of a metal selected from the group consisting essentially of scandium, yttrium, beryllium, rare earth metal and mixture thereof.

16 Claims, 2 Drawing Sheets

PROTECTIVE METAL SILICATE COATING FOR ELECTRODELESS HID LAMPS

BACKGROUND OF THE INVENTION

1. Field of the Invention

This invention relates to an electrodeless arc discharge lamp having a protective coating inside the arc chamber. More particularly, this invention relates to a high intensity electrodeless, metal halide arc discharge lamp with a protective coating of metal silicate on the interior, equatorial portion of the arc chamber.

2. Background of the Disclosure

A new class of high intensity arc discharge (HID) lamps has been developed called electrodeless lamps. Such lamps have a light-transmissive, electrodeless arc chamber or tube generally shaped like a pillbox or slightly flattened sphere and containing a fill which comprises a suitable inert buffer gas and one or more metal halides, including a halide of an alkali metal such as sodium. Radio frequency (RF) energy applied or coupled to the fill via capacitive or inductive coupling generates a light-emitting arc. In operation of such a lamp via inductive coupling, the arc tube or chamber acts as a single-turn secondary coil of a transformer and is surrounded by an RF energy excitation coil which acts as a primary coil. Various embodiments of such lamps are disclosed, for example, in U.S. Pat. Nos. 4,810,938; 4,972,120; 4,959,584 and 5,039,903 all of which are assigned to the assignee of the present invention.

Some of the problems associated with these lamps relate to arc instability and devitrification of the interior surface of the fused quartz arc chamber, particularly at the equatorial portion which is closest to the plasma arc discharge and where the induced electric field is the highest. It is known that the alkali metal present in the fill, such as sodium, forms an alkali metal silicate (i.e., sodium silicate) with the fused quartz arc tube wall, thereby depleting the arc of its sodium content and leaving free halogen behind. This results in accelerated devitrification of the fused quartz, shift in emitted color and promotes arc instability.

Continuing research and development has been directed towards reducing the sodium loss and arc chamber devitrification, while maintaining the relatively high color rendering index (CRI) and lamp efficacy exhibited by these lamps, by applying a protective coating, such as beryllium oxide or silicon, to the interior arc chamber surface as is disclosed in U.S. Pat. Nos. 5,032,762; 5,057,751 and 5,098,326.

SUMMARY OF THE INVENTION

It has been discovered that alkali metal loss, chemical etching and devitrification of the fused quartz arc chamber can be substantially reduced if a suitable protective metal silicate coating is present only or primarily on the equatorial portion of the inner arc chamber surface. This is particularly surprising in view of the prior art in which a coating is applied to the entire inner surface of the arc chamber. Thus, the present invention relates to an arc discharge lamp, particularly a high intensity or HID electrodeless arc discharge lamp, comprising a fused quartz arc chamber or tube having a metal silicate coating of a metal selected from the group consisting essentially of scandium, yttrium, beryllium, rare earth metal and mixture thereof present primarily on the equatorial portion of the interior arc chamber surface and wherein said arc chamber contains a fill for initiating and sustaining an arc discharge which includes a halide of an alkali metal. In most embodiments the fill will also include an inert buffer gas and a halide of at least one additional metal such as a rare earth metal. Thus, the present invention relates to a high intensity electrodeless arc discharge lamp comprising a light-transmissive, fused quartz arc chamber containing a fill which comprises a halide of an alkali metal, said lamp further including means for applying or coupling electrical energy, and particularly radio frequency energy, to said fill to produce a light-emitting arc wherein a metal silicate coating of a metal selected from the group consisting essentially of scandium, yttrium, beryllium, rare earth metal and mixture thereof is present primarily on the equatorial portion of the interior arc chamber surface.

DETAILED DESCRIPTION

Figure 1:
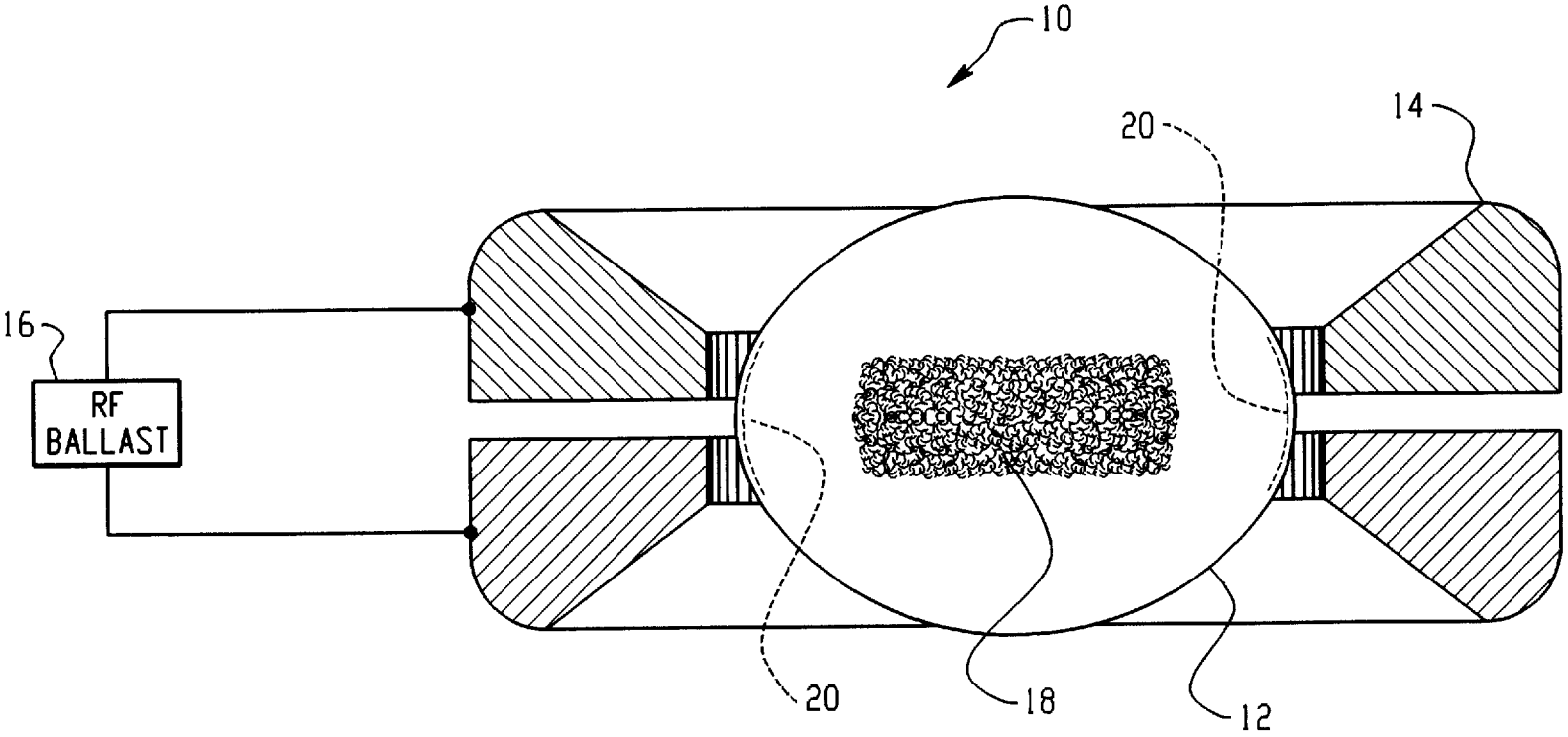
FIG. 1 schematically illustrates an electrodeless arc discharge lamp useful in the practice of the invention in which only the interior equatorial surface of the arc chamber is coated with a metal silicate coating according to the invention.

FIG. 1 schematically illustrates a high-intensity, metal halide electrodeless arc discharge lamp 10 according to the present invention which includes a fused quartz arc chamber 12 in the general shape of a flattened sphere or pillbox having a metal silicate coating 20 according to the invention only on the interior, equatorial portion of the arc chamber which is nearest the toroidal arc plasma 18. Other arc chamber shapes such as generally spherical, ellipsoidal, etc., may be used provided that such shape permits the formation of an arc within the arc chamber. Electrical power in the form of an RF signal is applied to the arc chamber by an excitation coil 14 disposed about arc chamber 12 and connected in the embodiment shown to an RF power supply or ballast 16. In this embodiment the RF power is inductively coupled to the arc 18 which is in the form of a torus. Excitation coil 14 is illustrated as a two-turn coil having the configuration shown wherein the overall shape of the excitation coil is generally that of a surface formed by rotating a bilaterally symmetrical trapezoid about a coil center line situated in the same plane as the trapezoid, but which line does not intersect the trapezoid. Such a coil configuration results in very high efficiency and causes only minimal blockage of light from the lamp. This particular coil configuration is described in greater detail in U.S. Pat. No. 5,039,903 the disclosures of which are incorporated herein by reference. However, other suitable coil configurations may be used, such as a solenoidal shape or that described in commonly assigned J. M. Anderson U.S. Pat. No. 4,812,702, issued Mar. 14, 1989, which patent is hereby incorporated by reference. The choice of coil configuration, location and shape will be determined by the practitioner In operation, RF current in coil 14 results in a time-varying magnetic field which produces within arc tube or chamber 12 an electric field that closes upon itself. Current flows through the fill within chamber 12 as a result of this solenoidal electric field, producing a toroidal arc discharge 18 in chamber 12. The operation of an electrodeless high intensity discharge lamp is described in U.S. Pat. No. 4,810,938. Suitable operating frequencies for the RF power supply range from 0.1 megahertz to 300 megahertz.

Fused quartz arc chamber 12 is electrically insulative and light-transmissive and is generally made by fusing high purity silica sand having a silica content greater than 96% $SiO_2$ and preferably greater than 99% $SiO_2$. However, uncrystallized or crystallized synthetic quartz and Vycor having a purity of greater than 96% $SiO_2$ and preferably greater than 99% $SiO_2$ can also be used. An arc chamber for a lamp of the invention will have hermetically sealed within it a fill for initiating and sustaining an electrodeless arc discharge, said fill comprising a halide of an alkali metal such as sodium, along with an inert buffer gas, as is disclosed in U.S. Pat. No. 4,783,615. However, in most embodiments the fill will also include a halide of at least one additional metal which contributes to the light-emitting arc discharge of which illustrative, but non-limiting examples include, cesium, tin the rare earth metals such as cerium, neodymium, dysprosium, holmium, thulium, etc., and mixtures thereof. It has been found that rare earth and other heavier metals present in the arc plasma cause chemical etching of the wall reducing the mechanical strength of the fused quartz arc tube or chamber. Preferred halides include iodides, chlorides, bromides and mixtures thereof, with iodides being preferred. Preferred buffer gases are krypton (Kr), xenon (Xe), argon (Ar) and mixtures thereof.

The metal silicate coating of the invention is a light-transmissive, glassy coating, region or zone (all "coating") or in the equatorial region of the inner wall of the fused silica arc chamber and comprises a silicate of a metal selected from the group consisting essentially of scandium, yttrium, beryllium, rare earth metal or mixture thereof and is preferably continuous and thick enough to reduce sodium loss from the metal halide fill with its attendant release of free halogen and devitrification of the fused quartz arc chamber wall. These coatings have also been found to reduce both arc chamber wall etching and reaction of the other metal species that may be present in the arc plasma in the arc chamber, such as rare earth metal, etc., with the $SiO_2$ of the arc tube wall. This further reduces buildup of free halogen, thereby extending the useful life of the lamp. The thickness of the coating or zone will generally range between about 2 to about 30 micrometers. In the embodiment illustrated in FIG. 1, the coating 20 is present only on the equatorial portion of the inner arc chamber surface and is surrounded outside the chamber by the two-turn, heavy coil 14. In this embodiment, even if the coating absorbs some of the light radiation emitted by the arc 18, it won't make much of a difference in either color or amount of the emitted light due to the presence of coil 14.

The metal silicate coating can be applied to the equatorial portion of the interior wall surface of the arc chamber or tube as a coating of metal silicate and fused onto the wall. Alternately, a coating of metal oxide, or a coating of a metal oxide or silicate precursor may be applied and decomposed and fused. Any of several known methods may be employed including coating from a metal alkoxy sol or gel, with thermal conversion to the oxide or silicate; from a suspension of finely divided, metal silicate or oxide in a carrier liquid; from a solution or suspension of a precursor followed by conversion of the precursor into the silicate or oxide; from a powder, frit or slurry of the oxide or silicate, or by chemical vapor deposition (CVD) or LPCVD of a precursor, such as a metal acetyl acetonate, with pyrolytic decomposition of the precursor into the metal oxide. These coatings are then fused into the equatorial, interior wall portion of the silica arc chamber using, for example, a flame, to form a substantially continuous zone of metal silicate on or within the silica of the interior wall.

For example, a precursor, such as scandium or yttrium acetyl acetonate, may be deposited by chemical vapor deposition, atmospheric or low pressure, with pyrolytic decomposition at a temperature of about 300° C. to form a coating of scandium or yttrium oxide, $Sc_2O_3$ or $Yt_2O_3$, which is then fused into the silica at a temperature of about 1800° C. to form a zone of glassy yttrium or scandium silicate. Alternately, yttrium or scandium or rare earth metal oxide or mixture thereof may be deposited from a suspension thereof, dried, and fused into the silica at a temperature of about 1400°–1800° C. The coating may also be applied as a metal silicate powder or frit which is then fused onto and into the inner wall of the fused silica arc tube.

Thus, if a metal silicate is present on the equatorial portion of the interior wall surface of the fused silica arc chamber, whether formed from a suitable silicate precursor or applied as a metal silicate, it is heated to fuse it into a coherent, continuous coating which also fuses it into the wall. Thus, a sharply definable interface between the coating and wall may not exist and continued heating will drive at least a portion into the wall as a zone of metal silicate. Thus, the term "coating" as used herein includes a coating as such, a zone, and combination thereof. If a metal oxide of a metal selected from the group consisting essentially of scandium, yttrium, beryllium, rare earth metal and mixture thereof is applied as an oxide, it is heated at a temperature of about 1800° C. to fuse it into the silica arc chamber surface which converts it to the silicate (which includes a solution of oxide in the silicate). The heating and fusion is easily accomplished by applying a hydrogen-oxygen torch to the exterior surface of the arc chamber and rotating the arc chamber or tube.

As set forth above, in the practice of the invention the metal silicate coating is present primarily on the equatorial portion of the interior arc chamber surface, which is that portion of the interior surface closest to the arc plasma and not on the entire interior surface. In the embodiment wherein the arc chamber is spherical or a flattened sphere as illustrated in FIG. 1, the equatorial surface is coincident with the largest diameter or circumference of the chamber, nearest to the arc plasma 18. The coating is present as a band around the equatorial surface generally slightly larger (wider) than the thickness of the toroidal arc plasma as illustrated in FIG. 1. Some departure from this is permissible, except that in the practice of the invention the coating is not present over the entire inner arc chamber wall.

The invention will be further understood with reference to the examples below.

EXAMPLES

Slighting flattened, spherical-shaped arc tubes or chambers, as illustrated in FIG. 1, made of fused quartz obtained by fusing high purity (99.99% $SiO_2$) natural occurring silica sand and having dimensions of 26 mm OD by 19 mm high and a 5.1 cc interior volume with a 1 mm wall thickness and open stems attached to both ends were coated on the interior equatorial region with a slurry made of 4 gm of yttrium silicate ($Y_2O_3$:$SiO_2$=28:72 molar ratio) powder uniformly mixed in 10 ml amyl acetate and ethyl cellulose. The coating was uniformly applied to the interior equatorial surface of the arc tubes as a 4 mm wide band by rotating the chamber as the slurry was injected into the chamber at the equator location. The dry coating weight was about 2.6. After drying, the coated arc tubes or chambers were then heated by a hydrogen-oxygen torch applied to the outer surface at the equatorial region while the chambers were rotated, until the coating became transparent. The yttrium silicate coated arc tubes were then baked in vacuum at 1100° C. for 12 hours after which both coated and uncoated arc tubes or chambers were filled with a mixture of 9.5 mg NaI and 4.5 mg $CeI_3$, along with krypton (gas) at a pressure of 250 torr.

Similar lamps were made from the same arc chambers, but without the yttrium silicate coating. During lamp operation the coldest portion of the arc chamber was about 900°–950° C. An RF coil as shown in FIG. 1 operating at 13.56 MHz furnished 475 watts of power to the arc. All the lamps were burned in at 475 watts for 100 hours after which free iodine absorbance was measured at a wavelength of 515 nm. The lamps were then operated at 475 watts continuously and free iodine absorbance measured as a function of time.

Figure 2:
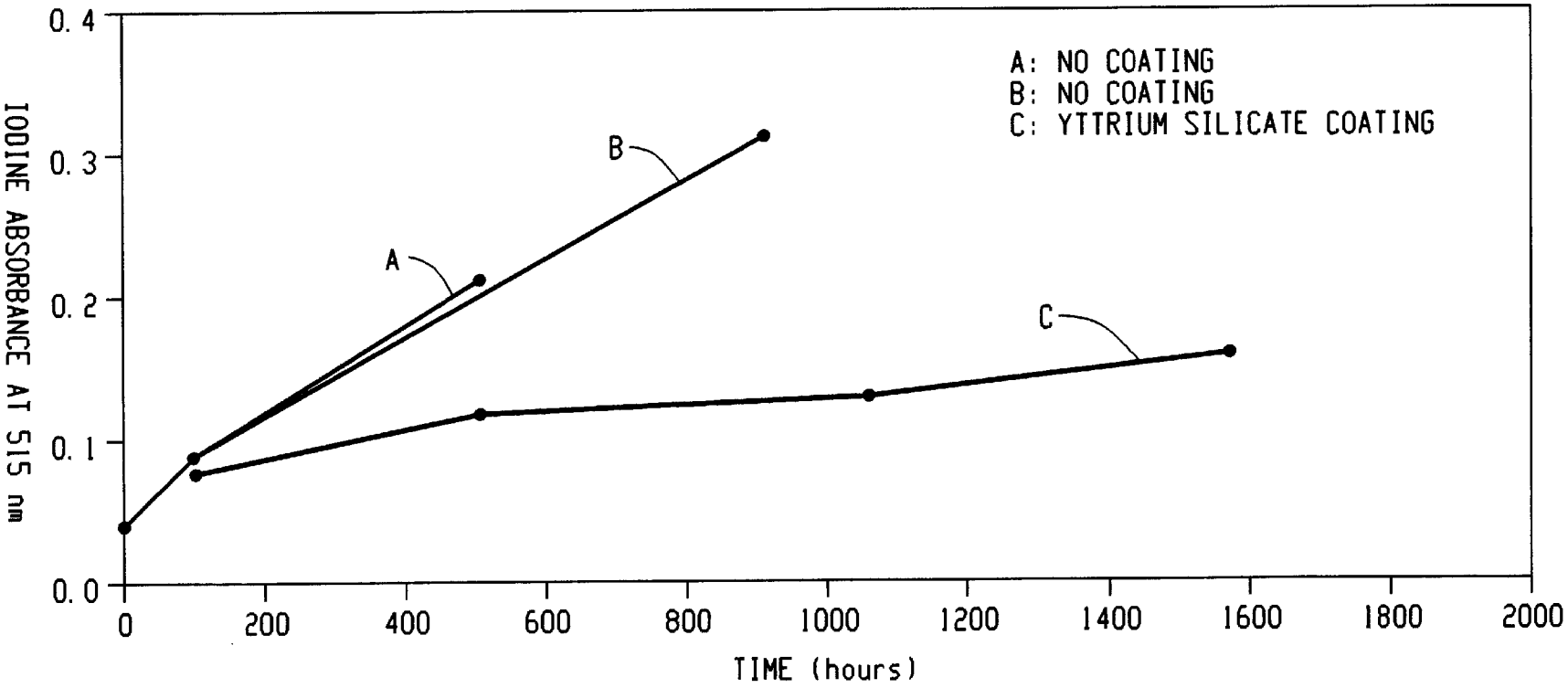
FIG. 2 is a graph of iodine absorbance at 515 nm as a function of operating time of an electrodeless lamp according to the invention and of the prior art.

FIG. 2 illustrates the intensity of the iodine absorbance measurement, which corresponds to the amount of free iodine present in the arc chamber, as a function of time. The advantage of the present invention having an yttrium silicate coating only at the equatorial region of the arc chamber is immediately apparent in that very little free iodine was released in the arc chamber after almost 1600 hours of lamp operation. In marked contrast, after only 750 hours of operation lamps with no coating had more than twice the amount of free iodine present as the lamps of the invention. The foregoing is intended to be illustrative, but not limiting with respect to the practice of the invention.

What is claimed is:

1. A light-transmissive, fused quartz arc chamber for an electrodeless arc discharge lamp, said chamber containing a fill comprising an alkali metal halide for initiating and sustaining an arc discharge and having a protective coating of metal silicate present primarily on an equatorial portion of an interior arc chamber surface, a remainder of the interior arc chamber surface being substantially free of the protective coating.

2. An arc chamber according to claim 1 wherein said alkali metal comprises sodium.

3. An arc chamber according to claim 2 wherein said fill includes a buffer gas.

4. An arc chamber according to claim 3 wherein said fill also includes a halide of a rare earth metal.

5. An arc chamber according to claim 4 wherein said coating is a silicate of a metal selected from the group consisting essentially of scandium, yttrium, beryllium, rare earth metal and mixture thereof.

6. An arc chamber according to claim 1 wherein said coating is a silicate of a metal selected from the group consisting essentially of scandium, yttrium, beryllium, rare earth metal and mixture thereof.

7. An arc chamber according to claim 1 wherein said coating is present only on the interior equatorial surface of said chamber.

8. An arc chamber according to claim 5 wherein said equatorial portion is that portion of said interior arc chamber surface closest to said arc discharge.

9. A high intensity electrodeless metal halide arc discharge lamp comprising a light-transmissive, fused silicate arc chamber enclosing within a fill comprising at least one alkali metal halide for initiating and sustaining a torroidal plasma arc discharge, excitation means for coupling electrical power to said fill to produce said arc discharge, and a protective coating of metal silicate disposed primarily on an equatorial portion of an interior arc chamber surface, a non-equatorial portion of the interior arc chamber surface being substantially free of the protective coating.

10. A lamp according to claim 9 wherein said alkali metal comprises sodium.

11. A lamp according to claim 10 wherein said fill includes a buffer gas.

12. A lamp according to claim 11 wherein said fill also includes a halide of a rare earth metal.

13. A lamp according to claim 9 wherein said coating is a silicate of a metal selected from the group consisting essentially of scandium, yttrium, beryllium, rare earth metal and mixture thereof.

14. A lamp according to claim 12 wherein said coating is a silicate of a metal selected from the group consisting essentially of scandium, yttrium, beryllium, rare earth metal and mixture thereof.

15. A lamp according to claim 9 wherein said coating is present only on the equatorial surface of said chamber.

16. A lamp according to claim 13 wherein said equatorial portion is that portion of said interior arc chamber surface closest to said arc discharge.

* * * * *